US009816267B2

(12) United States Patent
Farrell

(10) Patent No.: US 9,816,267 B2
(45) **Date of Patent: *Nov. 14, 2017**

(54) MASONRY BLOCK WITH CONTINUOUSLY CURVED SURFACES

(71) Applicant: Veritas Medical Solutions, LLC, Harleysville, PA (US)

(72) Inventor: David P. Farrell, Malvern, PA (US)

(73) Assignee: VERITAS MEDICAL SOLUTIONS LLC, Harleysville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/833,696

(22) Filed: Aug. 24, 2015

(65) Prior Publication Data

US 2016/0024784 A1 Jan. 28, 2016

Related U.S. Application Data

(63) Continuation of application No. 13/060,157, filed as application No. PCT/US2009/054814 on Aug. 24, 2009, now Pat. No. 9,183,957.

(Continued)

(51) Int. Cl.
*E04B 5/04* (2006.01)
*E04B 1/92* (2006.01)

(Continued)

(52) U.S. Cl.
CPC ..... *E04B 1/92* (2013.01); *E04B 1/043* (2013.01); *E04C 1/39* (2013.01); *G21F 1/04* (2013.01);

(Continued)

(58) Field of Classification Search
CPC ..... G21F 3/00; G21F 1/04; E04B 2002/0228; E04B 2002/0213; E04B 1/92; E04B 1/043; E04C 1/39; E04C 2001/925

(Continued)

(56) References Cited

U.S. PATENT DOCUMENTS 2,462,289 A 2/1949 Rochow
2,932,745 A 4/1960 Alberti et al.

(Continued)

FOREIGN PATENT DOCUMENTS

FR 2398142 2/1979
GB 1533980 11/1978

OTHER PUBLICATIONS

International Search Report issued in corresponding International Patent Application No. PCT/US2009/054814 dated Dec. 14, 2009.

(Continued)

*Primary Examiner* — Basil Katcheves
*Assistant Examiner* — Joshua Ihezie
(74) *Attorney, Agent, or Firm* — Volpe and Koenig, P.C.

(57) ABSTRACT

A radiation shielding block for constructing structural walls having flat opposed front and rear surfaces defining a thickness of the block, continuously curved, sinusoidal opposed left and right surfaces and top and bottom surfaces. The continuously curved, sinusoidal surfaces have a regular repeating wavelength pattern having a wave direction that is perpendicular to the flat front and rear surfaces, and a length that is two complete wavelengths of a sinusoidal wave. A plurality of the radiation shielding blocks are stackable in a staggered wythe construction having a plurality of wythes and at least one successive course of blocks set atop a previous course of blocks such that the continuously curved, sinusoidal surfaces of the successive course of blocks engage complementary continuously curved, sinusoidal surfaces of the previous course of blocks, and the successive course of blocks is offset by one wavelength from the previous course in a front-rear direction.

8 Claims, 4 Drawing Sheets

Related U.S. Application Data

(60) Provisional application No. 61/090,978, filed on Aug. 22, 2008.

(51) Int. Cl.

| | |
|---|---|
| ***G21F 1/04*** | (2006.01) |
| ***G21F 3/00*** | (2006.01) |
| ***E04B 1/04*** | (2006.01) |
| ***E04C 1/39*** | (2006.01) |
| *E04B 2/02* | (2006.01) |

(52) U.S. Cl.
CPC ..... *G21F 3/00* (2013.01); *E04B 2001/925* (2013.01); *E04B 2002/0213* (2013.01); *E04B 2002/0228* (2013.01)

(58) Field of Classification Search
USPC ..... 52/302.4, 503, 504, 505, 574, 604, 606, 52/607, 608, 609
See application file for complete search history.

(56) References Cited

U.S. PATENT DOCUMENTS

| | | | | |
|---|---|---|---|---|
| 2,970,218 | A | | 1/1961 | Shaw |
| 3,416,276 | A | | 12/1968 | Caputo |
| 3,614,446 | A | | 10/1971 | Leuthold |
| 3,635,459 | A | | 1/1972 | Mare |
| 4,035,975 | A | | 7/1977 | Gergely |
| 4,101,255 | A | | 7/1978 | Fernaeus et al. |
| 4,107,894 | A | | 8/1978 | Mullins |
| 4,414,339 | A | | 11/1983 | Solc et al. |
| 4,437,013 | A | | 3/1984 | Hondorp |
| 4,512,685 | A | | 4/1985 | Hegle |
| 4,593,513 | A | | 6/1986 | Stratton |
| 4,711,606 | A | | 12/1987 | Leling |
| 4,773,790 | A | | 9/1988 | Hagenah |
| 4,787,185 | A | | 11/1988 | Gascho |
| 4,936,712 | A | | 6/1990 | Glickman |
| 4,973,192 | A | | 11/1990 | Hair |
| 5,178,921 | A | * | 1/1993 | Whelan ..... B32B 9/00 110/182.5 |
| 5,428,934 | A | | 7/1995 | Tomek |
| D377,397 | S | | 1/1997 | Craig |
| 5,633,508 | A | | 5/1997 | Schleppenbach |
| 5,921,705 | A | | 7/1999 | Hodson et al. |
| 6,286,251 | B1 | | 9/2001 | Whitson |
| D457,656 | S | | 5/2002 | Bilka |
| 6,606,835 | B1 | | 8/2003 | Bilka |
| D481,136 | S | | 10/2003 | Dean et al. |
| 6,811,352 | B1 | | 11/2004 | Meerkerk |
| 6,948,282 | B2 | | 9/2005 | Bott |
| 7,037,047 | B1 | | 5/2006 | Tufts et al. |
| 7,040,241 | B2 | | 5/2006 | Coates |
| 7,185,470 | B1 | | 3/2007 | Link |
| 7,305,803 | B2 | | 12/2007 | Correa et al. |
| 2002/0023403 | A1 | | 2/2002 | Whitson |
| 2003/0009970 | A1 | | 1/2003 | MacDonald et al. |

OTHER PUBLICATIONS

Supplementary EP Search Report issued in corresponding European Application No. 09808923.8 dated Mar. 22, 2012.
Summons issued in corresponding European Patent Application No. 09808923.8 dated Jul. 31, 2014, consisting of 3 pp.
Anonymous: "Standard Lead Brick & Interlocking Lead Brick", Jun. 17, 2008, XP055104246, Retrieved from the Internet: URL:https:/web.archive.org/web/20080617012243/http://www.radiationproducts.com/bricks.htm, consisting of 2 pp.
Anonymous: "High Density Concrete Block", May 20, 2007, XP055104271, Retrieved from the Internet: URL:https://web.archive.org/web/20070520094642/http://www.jzimaging.com/Nelco_high_density_block.htm, consisting of 1 pp.
International Preliminary Report on Patentability issued in corresponding International Patent Application No. PCT/US2009/054814 dated Feb. 22, 2011.

* cited by examiner

MASONRY BLOCK WITH CONTINUOUSLY CURVED SURFACES

CROSS REFERENCE TO RELATED APPLICATIONS

This application is a continuation of U.S. patent application Ser. No. 13/060,157, which has a 371(c) filing date of Mar. 4, 2011, which is a national stage application of PCT Application No. PCT/US2009/054814, filed Aug. 24, 2009, which claims the benefit of U.S. Provisional Application No. 61/090,978, filed Aug. 22, 2008, which applications are incorporated by reference as if fully set forth.

FIELD OF INVENTION

The present invention is directed to interlocking building block with continuously curved surface profiles suitable for general wall construction, and, when using desirably dense materials, particularly suitable for constructing walls capable of significantly blocking electromagnetic radiation, such as photon, gamma, and neutron radiation.

BACKGROUND

Modern nuclear radiation facilities, such as medical treatment and diagnostic facilities, require shielding structures to prevent leakage of radiation from the immediate site and origin of radiation to the surrounding environment. Generally, this shielding structure is constructed in the form of a room housing the source of radiation, whose walls comprise sufficiently dense materials at sufficiently deep thickness to insure blocking of radiation from escape to the outside of the room.

The most common method of constructing radiation-shielding structures involves pouring concrete walls, ceilings, and floors that can reach thicknesses of up to 10 feet. Higher-density varieties of concrete providing improved attenuation of gamma and neutron radiation exist, but they are difficult and expensive to pour in the same manner as traditional concrete. One method of utilizing this higher-density concrete material is to pre-fabricate blocks of cured concrete that can later be used to construct a shielding structure. The use of blocks permits reconfiguration of the shield for different experiments, and allows the shield to be disassembled for access to components located behind it. In addition, the shielding blocks are normally provided with a stepped offset to avoid direct line-of-sight radiation streaming, albeit with limited success, thereby necessitating the need for a plurality of wythes (i.e., multiple layers of complete walls). Due to inherently loose tolerances in concrete block formation, large gaps may result between adjacent blocks. In such cases, suitable radiation resistant material must be filled in these gaps. U.S. Pat. No. 4,437,013, for example, discloses such materials.

Conventional walls constructed using block generally employ mortar joints between blocks in each horizontal row or course, as well as between each course of blocks vertically layered on top of each other. Walls built with such mortared joints may yield an aesthetically pleasing, decorative appearance, revealing the block pattern, but they tend to be expensive, due at least in part to the cost of the mortar material and the labor cost involved in preparing and applying the mortar at the construction site. Such mortared construction is ordinarily performed by a skilled mason, thereby increasing the cost. Another disadvantage associated with mortared wall construction is that the joints are the weakest links in the structure. The concrete blocks themselves are typically crafted at a factory in a controlled environment, while mortar is applied under varying conditions on-site. In the end, block walls with relatively weak mortar joints are particularly susceptible to seismic damage.

Mortarless joint construction block systems offer an alternative to the labor intensive process used to prepare structures with mortar joints. These mortarless joint systems often rely on specific features that are formed on the blocks to interlock the blocks and hold the resulting wall together. In some cases the blocks may be designed for construction of walls comprising reinforced materials, such as re-bar, I-beams, and the like. U.S. Pat. No. 4,512,685 discloses examples of mortarless block wall construction. Reinforcement is commonly accomplished through voids designed in the blocks themselves, while the present invention may also include reinforcement by leaving gaps between blocks in a course. Such voids may thereafter be filled with mortar or other material, such as mortar, concrete, or other materials, including materials of like composition to the blocks.

Standard rectangular pre-formed concrete blocks are not suitable for use in radiation shielding structures because their layering in courses necessarily yields seams between blocks in a course, and between horizontally layered courses, which seams permit radiation to pass through the shielding structure. Additionally, multiple wythes are required in order to provide adequate shielding for the entire structure, thereby contributing to increased costs of materials and labor.

Other commonly used profile shapes, such as squares and triangles, also create seams between blocks that allow radiation to travel between the blocks relatively unattenuated. For example, U.S. Pat. Nos. 7,305,803, 4,107,894 and D377,397 disclose interlocking blocks capable of being constructed into walls, but all leave seams which do not block radiation. U.S. Pat. No. 4,035,975 discloses block with a variety of profiles, from triangular to curved, but all of its disclosed profiles yield seams with the same problem—the inability to block radiation. This is not altogether surprising in that the profiles used for interlocking blocks are shaped in such a way to provide only the ability for the blocks to interlock, without the appreciation (much less the solution) for eliminating radiation-passing seams. Additionally, the sharp angles of any such notched profiles are prone to breakage even with careful handling of the blocks when stacked on palettes for delivery to the construction site. Such breakage results in decreased locking-in of adjacent blocks, or even the inability to use such broken blocks, adding cost to construction.

Moreover, the curved profiles described in U.S. Pat. No. 4,035,975 provide for courses to be locked in one dimension only—side-to-side—providing no solution to forward backward mobility. Likewise, the profile described in D377,397 may provide both side-to-side and forward-backward immobility, but its seams between blocks fail to provide adequate radiation resistance, in part due to the substantially large voids found within the blocks but also due to the substantially long horizontal seams found within stacks of blocks.

No existing blocks provide the advantages of the present invention. The art is in need of such improved building blocks.

SUMMARY

The present invention provides immobility in multiple dimensions, and thereby provides superior wall building construction. Further, the present invention provides vastly superior radiation resistance because its blocks' profiles are capable of mating with adjacent blocks not only in multiple dimensions but also in a manner which minimizes seams through the courses and wythes of a wall constructed with such blocks.

In one aspect, the present invention addresses the disadvantages of prior wall construction by using interlocking building block capable of blocking radiation. While the blocks of the invention are suitable for general wall construction, the use of desirably dense materials render the blocks particularly useful for constructing walls capable of significantly blocking electromagnetic radiation, including but not limited to photon, gamma, and neutron radiation. Particularly, the blocks are molded into a shape conducive to interlocking with other adjacent blocks in two perpendicular directions. The profile of the blocks resembles a "tongue and groove" pattern, constructed of two identical and therefore complementary continuously curved surfaces, such as sine waves, which abut one another and thereby fit together firmly. This pattern minimizes the opportunity for radiation to "stream" through horizontal seams between blocks, and wythes or layers of the wall, resulting in a system of interlocking finite elements which behave more akin to a homogenously poured slab of masonry material. When constructed of a desirably dense material, substantial radiation protection is provided, suitable for use in rooms designed for housing medical radiation treatment and diagnostic apparatus. Alternatively, the blocks of the present invention confer substantial advantages when merely used for conventional wall building purposes.

In light of the above, it is an object of the present invention to provide masonry block construction systems having interlocking, self-aligning blocks. It is another object of the present invention to provide a block construction system for producing walls that can withstand frequent seismic activity. Yet another object of the present invention is to provide a block construction system which is easy to use, relatively simple to implement, and comparatively cost effective. It is a further object of the invention to provide blocks capable of building radiation blocking walls.

The present invention is directed to a block construction system having interlocking, self-aligning blocks that can be used to construct walls of various shapes and sizes. Because the blocks lock together, mortar joints between blocks are not required, although mortar may optionally be used between horizontal courses of blocks as desired, preferably only every third, fourth, or fifth course rather than between every course.

In general, the blocks of the present invention are modified parallelopipeds, or more particularly modified rectangular cuboids, in that they have 6 faces or surfaces, opposing pairs of which are essentially parallel. They have front and rear surfaces, top and bottom surfaces, and left and right surfaces. At least two of the pairs of opposing surfaces are modified to be continuously curved surfaces, while the remaining pair of opposing surfaces (generally the front and rear) may remain flat and generally planar. In one aspect the front and rear surfaces are substantially flat, while the other four surfaces are not flat, but instead can be described as continuously curved in cross section. In one aspect, the curved surfaces of the top, bottom, left and right faces are continuously curved such that there are no sharp angles on the surfaces. In one aspect, the continuously curved surfaces each comprise two complete wavelengths of a sine wave; that is, the block's thickness in either dimension is equal to two wavelengths of the cross-sectional sine curve. The continuously curved surfaces of opposite faces are in phase with each other, such that two identical blocks may be placed side to side and "fit" together, and may likewise be stacked one on top of another and "fit together". FIGS. 1*a*, 1*b*, 2*a*, 2*b*, 3*a*, 3*b*, 4*a*, 4*b*, 5*a*, and 5*b* illustrate such blocks.

While the invention is described in terms of pairs of opposite surfaces (front and back, top and bottom, left and right), it is intended that these terms are merely for sake of convenience—they may be interchanged as desired depending on the nature of the construction in a vertical wall or a horizontal wall (ceiling or floor). For example, a block constructed vertical wall would have top and bottom surfaces in a continuous curve, and left and right surfaces in a continuous curve, while the front and rear surfaces would be substantially planar. Conversely, in a block constructed ceiling, the top and bottom surfaces would be the flat, substantially planar surfaces, while the front and back Pair and the left and right pair would be the surfaces whose cross sections are continuously curved.

The cross section of the curved surfaces may be sine waves, as described above, or may be any continuously curved function; the cross-sections have substantially no flat portions. For sine wave cross sectional surface areas, blocks of the invention include sine waves of a variety of amplitudes (peak-to-peak). By peak-to-peak amplitude it is meant the distance between the highest peak in the wave and the lowest trough in the wave. In other aspects, the amplitude of the cross sectional sine wave may be in a range from about 0.2 wavelengths to about 0.7 wavelengths. Preferably the amplitude is between about 0.2 wavelengths to about 0.5 wavelengths, more preferably, about 0.2 wavelengths to about 0.4 wavelengths.

Other aspects of the invention have surfaces with cross sectional curves described as distorted sine curves which may have portions having hyperbolic, parabolic, or other distortions, and the like. The term "sinusoidal" includes regular sine curves, distorted sine curves, and other wavelength bearing continuous curves. Again, a typical block will be two wavelengths thick, two wavelengths deep, and the amplitudes of the curves will range from about one wavelength to about one quarter wavelength. Regardless of the particular curve chosen, the curve will be continuous such that the surfaces have no sharp angles, acute or obtuse, but for the extreme corners of the blocks which will have angles approximating 90 degrees in each dimension.

Wall construction generally proceeds with the building of course upon course until the desired height is reached. Such a wall is considered a single wythe wall. However, the thickness of such a single wythe wall may well be insufficient for both radiation shielding purposes as well as mechanical stability and rigidity of the wall itself. A second wythe may then be built abutting the first wythe in order to confer additional thickness to the end-resulting wall, advantageous both in terms of structural integrity and radiation shielding capacity. Additional wythes may be constructed to improve these characteristics even further.

Even such a multi-wythed wall, however, may be further improved by staggering the wythes, each successive course being offset in a front-rear dimension, as discussed below in the Detailed Description of the Invention.

In one aspect, then, the invention is directed to a masonry block for constructing walls, the block having flat opposed front and rear surfaces, continuously curved opposed left and right surfaces, and continuously curved opposed top and bottom surfaces, and wherein the continuously curved surfaces are sinusoidal.

In another aspect, the walls are radiation-protective, and the block has a density in the range between 150 pounds and 400 pounds per cubic foot, or between 200 and 350 pounds per cubic foot, or between 250 and 313 pounds per cubic foot.

In yet another aspect the sinusoidal continuously curved surfaces are two wavelengths long. The continuously curved surface may be a sine wave in cross section, and in some aspects the amplitude of the sine wave is between about 0.2 and 0.7 wavelengths, or between about 0.2 and 0.4 wavelengths.

In another aspect, the block may be of conventional size. In another aspect, the block is 10 inches in width, 5 inches in height, and 5 inches in depth.

In yet another aspect, the invention provides a wall constructed with a plurality of blocks as previously described in other aspects. In some aspects, a plurality of courses of a single wythe of the wall are offset laterally by one half the width of the blocks. In other aspects, the wall is a single staggered wythe as described below, whose courses have been offset by one wavelength from adjacent courses. In such aspects, a plurality of half blocks may be placed in those courses offset and recessed from the exterior surfaces of the wall. Additionally, during construction, voids of appropriate dimension may be left in the wall for the insertion of reinforcement materials such as mortar, re-bar, I-beams, and other reinforcing materials, and combinations thereof.

These and other objects are achieved through the present invention as exemplified and further described in the Detailed Description of the Invention below.

BRIEF DESCRIPTION OF THE DRAWINGS

FIG. 6(*c*) is a schematic depiction of an embodiment of the invention wherein a wall is constructed using blocks turned on end to terminate one end of a three wythe wall.

DETAILED DESCRIPTION OF THE PREFERRED EMBODIMENTS

Figure 1A:
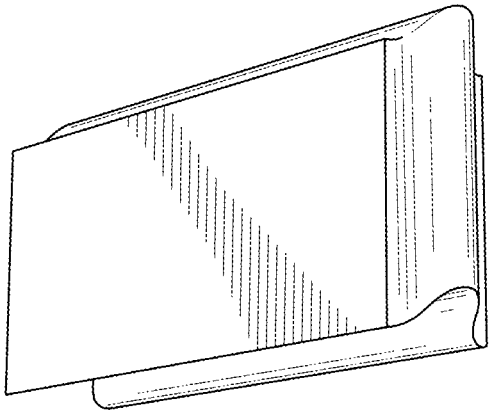
FIGS. 1*a* and 1*b* are schematic depictions of an embodiment of the present invention, illustrating a full block (FIG. 1*b*) and a half block (FIG. 1*a*) with sinusoidal curve profiles.
Figure 1B:
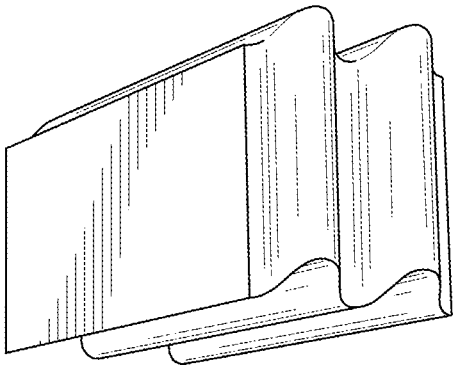
Figure 2B:
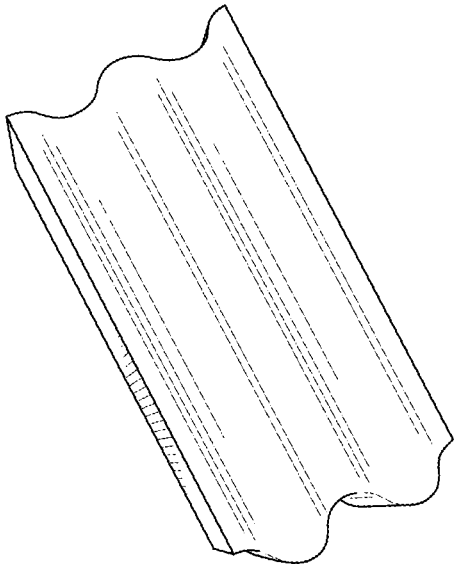
FIGS. 2*a* and 2*b* are schematic depictions of an embodiment of the present invention, illustrating a full block (FIG. 2*b*) and a half block (FIG. 2*a*) with sinusoidal curve profiles.
Figure 2A:
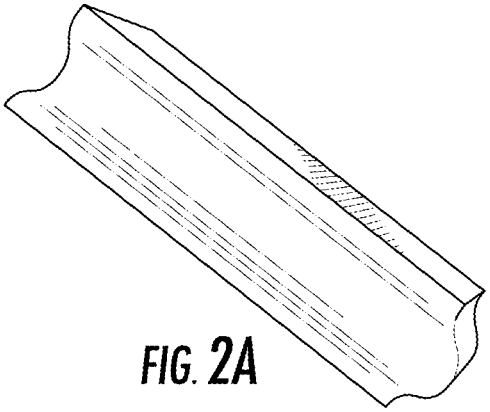
Figure 3B:
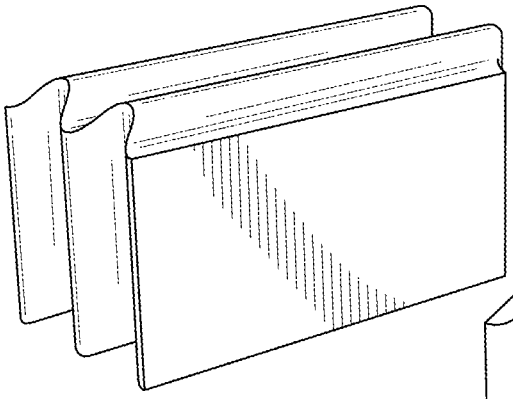
FIGS. 3*a* and 3*b* are schematic depictions of an embodiment of the present invention, illustrating a full block (FIG. 3*b*) and a half block (FIG. 3*a*) with sinusoidal curve profiles.
Figure 3A:
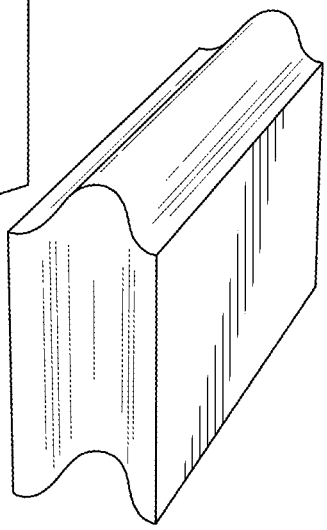
Figure 4B:
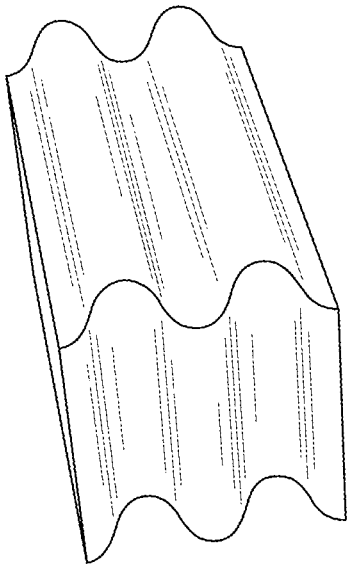
FIGS. 4*a* and 4*b* are schematic depictions of an embodiment of the present invention, illustrating a full block (FIG. 4*b*) and a half block (FIG. 4*a*) with sinusoidal curve profiles.
Figure 4A:
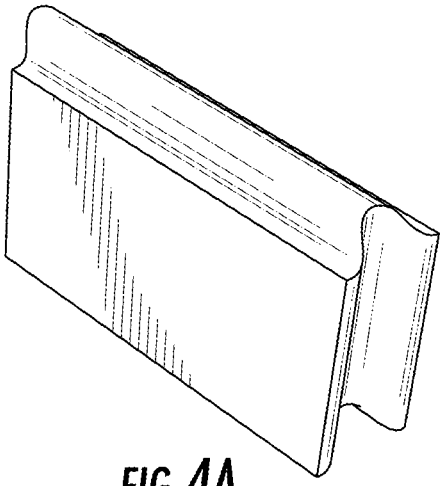
Figure 5A:
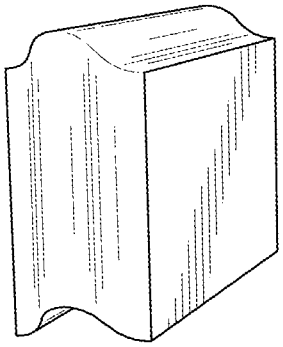
FIGS. 5*a* and 5*b* are schematic depictions of an embodiment of the present invention, illustrating a full block (FIG. 5*b*) and a half block (FIG. 5*a*) with alternative continuous curve profiles.
Figure 5B:
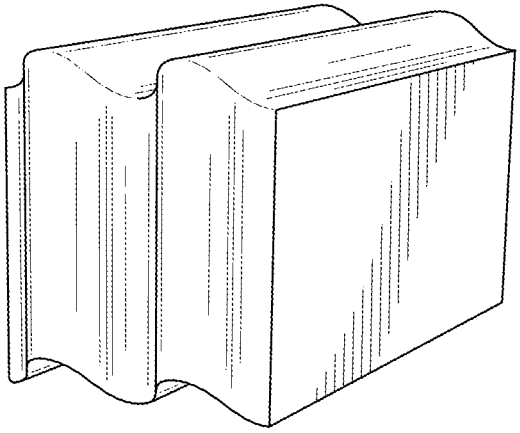

The present invention provides masonry blocks whose surfaces enable wall construction with interlocking blocks. This feature provides immobility and structural rigidity in multiple dimensions, and thereby provides superior wall building construction. Further, the present invention provides vastly superior radiation resistance because the surface profiles of the blocks are capable of mating and interlocking with adjacent blocks not only in multiple dimensions but also in a manner which minimizes seams through successive courses and wythes of a wall constructed with such blocks.

Continuously Curved Surfaces

In one embodiment, the present invention provides interlocking building blocks capable of blocking radiation. While the blocks of the invention are suitable for general wall construction, the use of desirably dense materials render the blocks particularly useful for constructing walls capable of significantly blocking electromagnetic radiation, including but not limited to photon, gamma, and neutron radiation. Particularly, the blocks are molded into a shape conducive to interlocking with other adjacent blocks in two perpendicular directions. The profile of the blocks resembles a "tongue and groove" pattern, constructed of two identical and therefore complementary continuously curved surfaces, such as sine waves, which abut one another and thereby fit together firmly. This pattern minimizes the opportunity for radiation to "stream" through horizontal and vertical seams between blocks, as well as through wythes or layers of the final wall, resulting in a system of interlocking finite elements which behave more akin to a homogenously poured slab of masonry material yet being far easier to construct as well as being more cost effective. Unlike poured concrete, in some embodiments (those without mortar usage) the walls may also be dismantled, and reconstructed in alternative conformations. When constructed of a desirably dense material, substantial radiation protection is provided, suitable for use in rooms designed for housing medical radiation treatment and diagnostic apparatus. Alternatively, the blocks of the present invention confer substantial advantages when merely used for conventional wall building purposes.

The blocks of the present invention are generally modified parallelopipeds, or more particularly modified rectangular cuboids, in that they have 6 faces or surfaces, opposing pairs of which are essentially parallel. By essentially parallel it is meant that each point on the curved surface is the same distance from the equivalent point on the opposite, continuously curved, surface. Thus all pairs of opposite points of the opposed curved surfaces are equidistant, and that distance is equal to the respective width, depth, or height of the block. They have front and rear surfaces, top and bottom surfaces, and left and right surfaces. At least two of the pairs of opposing surfaces are modified to be continuously curved surfaces, while the remaining pair of opposing surfaces (generally the front and back) may remain flat and generally planar. In one embodiment the front and rear surfaces are substantially flat, while the other four surfaces are not flat, but instead are continuously curved in cross section. In a preferred embodiment, the curved surfaces of the top, bottom, left and right are continuously curved such that there are no sharp angles on the surfaces, although the corners may be angular. In one preferred embodiment, the continuously curved surfaces each comprise two complete wavelengths of a sine wave; that is, the block's thickness in either dimension is equal to two wavelengths of the cross-sectional sine curve. The continuously curved surfaces of opposite faces are in phase with each other, such that two identical blocks may be placed side to side and "fit" together, and may likewise be stacked one on top of another and "fit together". FIGS. 1*a*, 1*b*, 2*a*, 2*b*, 3*a*, 3*b*, 4*a*, 4*b*, 5*a*, and 5*b* illustrate such blocks. For example, the curved top surface is shaped to substantially conform to the respective bottom curved surface of the block to be placed on top of it. Likewise, the side surfaces are shaped to substantially conform to the respective sides of adjacent blocks. In one embodiment, the wavelength of the curve of the top and bottom surfaces is the same as that of the side surfaces. In another embodiment, the wavelength of the top and bottom surfaces is different from that of the side surfaces.

Because the blocks' surfaces comprise two wavelengths of the continuous curve, blocks may be placed directly abutting such that their front and rear faces are coplanar, or may be placed offset by one wavelength (i.e., half of a block) to form a staggered conformation. Additionally, whether placed directly abutting or offset by one half block, the blocks are self-aligning because they fit together in an interlocking fashion, both in vertical and horizontal dimensions. Moreover, structural rigidity and integrity is enhanced because the blocks, once placed, are immobilized from movement both vertically and laterally forward-rearward. Side-to-side freedom, however, is useful and advantageous as described below for staggered courses (side-to-side offset).

The cross section of the curved surfaces may be any of a variety of continuous curves. Preferably, the curved surfaces are sinusoidal, and in cross-section have substantially no flat portions. For sine wave cross sectional surface areas, blocks of the invention may comprise sine waves of a variety of amplitudes. In one embodiment, the amplitude is that which is equal to one half the wavelength of the sine wave. In other embodiments, the amplitude of the cross sectional sine wave may be in a range from about 0.2 wavelengths to about 0.7 wavelengths. Preferably the amplitude is between about 0.2 wavelengths to about 0.5 wavelengths, more preferably, about 0.2 wavelengths to about 0.4 wavelengths.

Blocks of the invention may have surfaces with cross sectional curves described as sine curves, or distorted sine curves, or sine curves having hyperbolic, parabolic, and the like distortions. A typical block is two wavelengths thick, two wavelengths deep, and the amplitudes of the curves will range from about one wavelength to about one quarter wavelength. Regardless of the particular curve chosen, the curve will be continuous such that the surfaces have no sharp angles, acute or obtuse, but for the extreme corners of the blocks which have angles approximating 90 degrees in each dimension.

Block Dimensions

Blocks of the present invention may be formed to any convenient size suitable for wall construction. The dimensions of the full blocks of the invention may range, in any one dimension, from about 3 inches to about 16 inches. In one embodiment, the width is twice the height and twice the depth, but in other embodiments, the ratios of the three dimensions vary. Conventional concrete blocks (often with large internal voids) range in size but are generally about 16 inches wide by 8 inches high by 8 inches deep.

The present invention includes blocks of conventional size, but also includes blocks of other advantageous sizes. Particularly, the size of the blocks may be adapted for suitability in general construction (where conventional sizes may be appropriate) or may be adapted to provide a suitable weight per block, particularly where conventional size blocks may have disadvantageous weight properties when the blocks' composition is high density material. In one advantageous embodiment, the full size blocks of the invention are 10 inches wide by 5 inches high by 5 inches deep. Such a size combines advantageous weight properties for high density composition with sufficient size for many radiation facility wall construction specifications.

Half blocks of the invention have the same dimensions as full blocks in two dimensions, while the third dimension (depth) is half that of a full block. In this fashion, half blocks may be advantageously used in staggered wythe wall construction. In one embodiment, half blocks are 10 inches wide by 5 inches high by 2.5 inches deep to match the dimensions of the full blocks of the same height and width, and the halved depth is thus one wavelength long.

Other block configurations having some or all of the interlocking structures described above can be included in the block construction system. These other blocks include half-blocks as previously described, but also end blocks, corner blocks, bond beam blocks, tee blocks, crossing blocks and other specialty blocks. The different block configurations may be combined to construct walls of various shapes and sizes. See, for example, FIG. 6(*c*), in which blocks turned on end are used to terminate one end of a three wythe wall. In such a case, the continuous curve of the end surfaces is the same as that of the top and bottom surfaces. Such blocks turned on end may also be used in a staggered wythe wall as described below. Additionally, as wythes are interlocked such that the final wall construction is a staggered wythes wall, voids may be left during construction to establish vertically or horizontally aligned passageways in selected courses and wythes to accommodate reinforcement in the form of mortar, re-bar, I-beams, and other reinforcement materials.

Staggered Courses (Side-to-Side Offset)

Courses of blocks set atop each other may be staggered for further strengthening of the resulting wall. Due to the top and bottom surfaces of the blocks mating shapes, a block may be placed on top of a lower course with its sides aligning directly with the seam between blocks in the lower course, or may be staggered left and right by any amount. In this way the seams between blocks in each successive course may overlap the seams of the course below. In one embodiment, each successive course is offset side-to-side by half the width of a block, such that the seam between blocks of such course falls directly above the center of the block below it. In other embodiments, the offset ranges from zero to half the block width.

Staggered course construction may also be combined with staggered wythe wall construction as described below.

The blocks of the invention are amenable to the rapid construction of walls by masons, due to their unique curved features which provide for automatic alignment. Additionally, the blocks of the invention are particularly suitable for automated construction of walls by robotic machinery, which can lift and place many blocks in a single operation. Smaller robotic devices may lay as few as two or three blocks at a time, while larger devices may be able to place dozens of blocks simultaneously.

Staggered Wythe Walls (Front to Rear Offset)

The blocks of the present invention enable wall construction with staggered wythes, whereby a successive course of blocks is set atop a previous course, offset by one wavelength in a front-rear direction by half the thickness of the block. As the top faces of the blocks of multiple wythes match in surface shape, the bottom face of a successive course will fit snugly even while overlapping two blocks in previously laid abutting courses. For example, where a course of blocks is laid from one end to the other of the room to be enclosed, and a second wythe is begun immediately in front of the first course, the second course for both wythes may be a single course overlapping both previously laid courses, thereby overlapping both wythes. For a three wythe staggered wall, two such overlapping blocks may be placed on the three courses below. As discussed below, half blocks may be used to "fill" the gaps in the overlapping courses, rendering a final wall having a single thickness throughout its height, without individual independent wythes abutting each other. Instead, the thickness is the result of the interlocking staggering nature of the construction.

Staggered wythe construction inherently provides additional strength to the resulting wall, due at least in part to the ability to spread the load of successive courses on a greater base area, as opposed to each course applying its load solely on the course beneath. Additionally, staggered wythe construction also avoids the expense and labor of tying unstaggered wythes together with additional mechanisms, such as ties, leashes, and the like.

For such staggered wythe walls, and for other construction purposes, other block configurations having some or all of the interlocking structures described above may be included in a block construction system. These other blocks include half-blocks, end blocks, corner blocks, bond beam blocks, tee blocks, crossing blocks and other specialty blocks. These different block configurations can be combined to construct walls of various shapes and sizes.

For example, as shown in FIGS. 1(*a*), 2(*a*), 3(*a*), 4(*a*), and 5(*a*), half blocks comprising surfaces of length or width equal to one wavelength may be used to bring those courses which have been offset by one wavelength to the same depth as the other courses in the wythe. Stated alternatively, when one horizontal course has been offset rearward by one wavelength, such that its blocks rest half on one course of one wythe and half on a course of a second wythe at the same height (and interlocking with both), that offset course may have half blocks added to and abutting their front faces in order to render the wythe with a continuous smooth surface. Additionally, as wythes are added such that the final wall construction is equivalent to several wythes interlocked together with offset courses, to accommodate mortar and re-bar, voids may be left during construction to establish vertically or horizontally aligned passageways in selected courses, wythes, and staggered wythe walls.

The nature of the continuous curve and its amplitude provide for increased resistance to mechanical shear when compared with conventional block construction. Mortared block construction is particularly prone to mechanical shear as the mortar joints are far more susceptible to shearing forces than the blocks themselves. Other interlocking blocks also have substantial noncurved surfaces which also render their constructed products susceptible to shearing forces. The blocks of the invention, by contrast, have essentially the same shear-resistance at the seams as the bulk of the blocks themselves due to the interlocking curved surfaces mating closely with adjacent blocks.

Radiation Shielding

Radiation protection requires the interposition of high density material between the source and the outside environment. In facilities which use radiation, the source is generally housed in a machine in a shielded room. At least the walls and ceiling of the room, and in some cases the floor, must be appropriately shielded by sufficient thickness walls to prevent radiation from leaking out. Traditional wall construction, even with high density materials which are efficient at radiation blocking, is prone to seams between blocks that ultimately require additional wythes of walls to reach thicknesses capable of blocking radiation through the seams. By contrast, the present invention prevents seams capable of passing radiation, and thereby permits construction of a wall using the same high density materials but with fewer wythes, or a staggered wythe wall of reduced thickness. Additionally, because there is little to no need to mortar between blocks, courses, and wythes, both the cost and the length of time for building the walls are substantially diminished.

While blocks have been described in the art which reduce seams, none have essentially eliminated seams as in the present invention. Where a triangular profile block, for example, is able to reduce the seam, such blocks have been made with substantially horizontal portions in the profile of the surface of the block, thereby maintaining an open seam through which radiation may pass. At best, such blocks still permit a substantial portion of radiation (as much as one third to one half) to leak through the block seams because less material is interposed between the inside and outside of the wall. Walls constructed from such blocks need at least 50% more wythes to block the same percentage of radiation as walls constructed of blocks of the present invention.

Generally, blocks of the invention destined for use in radiation shielding have composition densities of between 200 and 400 pounds per cubic foot, preferably 220 to 375 pounds per cubic foot, more preferably between 230 to 340 pounds per cubic foot. In one embodiment, blocks of the invention have a density of 250 pounds per cubic foot. In another embodiment, blocks of the invention have a density of 313 pounds per cubic foot. Those of skill in the art will appreciate the requisite density for any particular radiation shielding application. For example, the American Concrete Institute publishes specifications for such high density concrete at Chapter 14 of ACI-301-05 "Specifications for structural concrete, reported by ACI committee 301." (2005, American Concrete Institute). Suitable materials, such as high density concrete, are known in the art and are available from a variety of manufacturers.

Walls constructed as described provide excellent radiation shielding, with essentially no seams through which radiation is permitted to leak. Compared to a conventional block construction with the same highly dense material but without the use of curved blocks of the invention, the wall of the invention provides the same radiation protection of a conventional wall of much greater thickness, as high as twice the thickness or even greater.

Other embodiments, uses, and advantages of the present invention will be apparent to those skilled in the art from consideration of the specification and following Examples, and practice of the invention disclosed herein. The specification and Examples should be considered exemplary only. The intended scope of the invention is limited only by the claims appended hereto.

EXAMPLES

The present invention will be further understood by reference to the following non-limiting Examples.

Example 1

An Embodiment of the Invention, Employing Blocks with Sinusoidal Curved Surfaces High-density concrete blocks of the invention can be produced in a variety of dimensions. Blocks were formed with the following dimensions: 5 inches square on end (height and depth) and 10 inches wide. For this block, the top and bottom surfaces have a cross-sectional continuous curve in the shape of a sine wave with the sine wave wavelength being one-half the width of the block, or 2.5 inches. The sine wave amplitude is independent of the dimensions of the block and can be selected based upon structural needs. In this Example, the amplitude (peak-to-peak) is 0.75 inches, that is, 0.3 times the wavelength. This block's left and right side are also continuously curved in a sinusoidal curve of the same wavelength, 2.5 inches.

The sine-wave profile on the bottom of the block is in phase with the respective wave on the top of the blocks, such that blocks interlock directly on top of one another. A similar pair of in-phase sine wave profiles are present on the sides of the block, to provide interlocking functionality in the lateral side-to-side direction.

This sine-wave profile allows subsequent block layers to be offset by one wave-length in a staggered wythe wall construction. This prevents wall wythes from separating from each other, effectively allowing the blocks themselves to hold the wall together.

FIGS. 1(*b*), 2(*b*), 3(*b*), 4(*b*), and 5(*b*) depict a full size block as contemplated by this Example, with one opposed pair of substantially planar surfaces and two pairs of surfaces featuring two wavelengths of regular sine curved cross-sections. FIGS. 1(*a*), 2(*a*), 3(*a*), 4(*a*), and 5(*a*) depict a half block with matching curved surfaces but only a single wavelength thereof.

In this Example, the blocks were composed of highly dense material, with a density of either 250 or 313 pounds per cubic foot.

Example 2

An Embodiment of the Invention, Employing Blocks with Distorted Sine Curve Surfaces The full size blocks of this Example bear surfaces whose cross-sections are two wavelengths of a distorted sine curve, as illustrated in Example 5(b). In all other respects, these blocks are essentially similar to those of Example 1, but for the shape profile of their respective curved surfaces. FIG. 5(*a*) depicts a half block bearing a single wavelength of continuously distorted sine curve.

Example 3

Figure 6A:
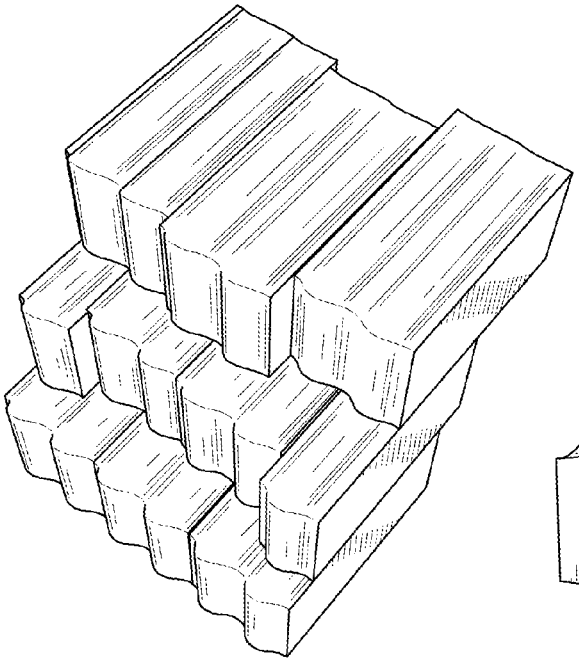
FIGS. 6(*a*) and 6(*b*) are schematic depictions of an embodiment of the present invention, illustrating a staggered wythe wall construction using full and half blocks of the invention. In the view shown in FIG. 6(*a*), the lower right side and the upper left (unseen) side are the exterior surfaces of the wall, while in FIG. 6(*b*), the left side and the right (unseen) side are the exterior surfaces of the wall. Both depict both staggered courses and staggered wythe construction, with half blocks shown in darker shading.
Figure 6B:
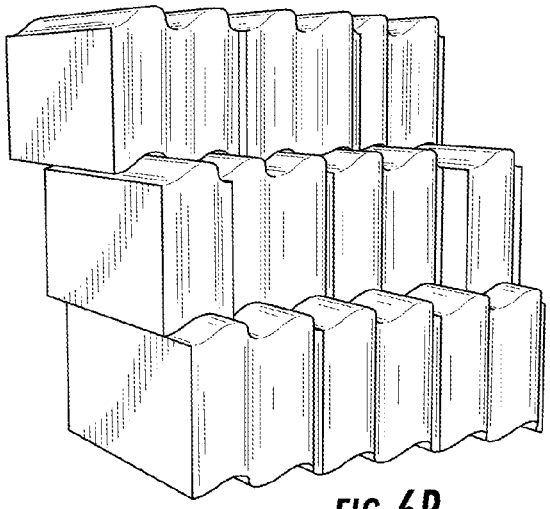
Figure 6C:
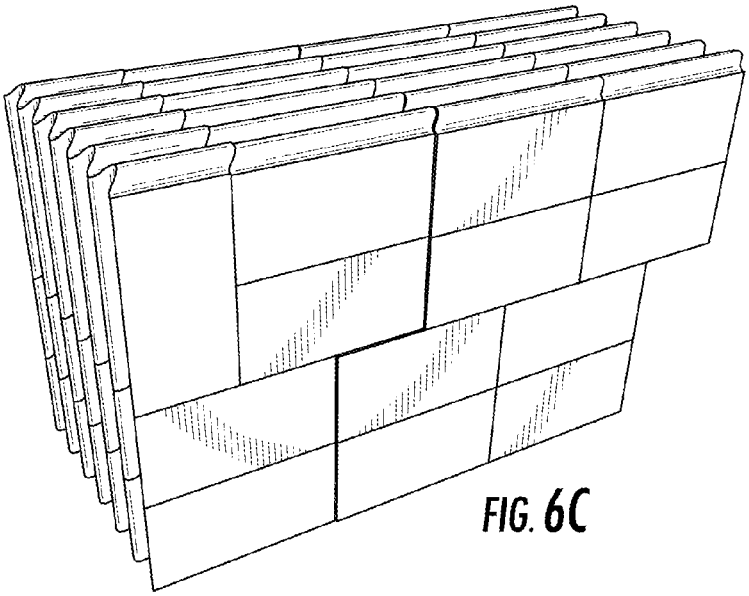

As shown in FIGS. 6(*a*) and 6(*b*), a staggered wythe wall construction uses full and half blocks of Example 1. In the view shown in FIG. 6(*a*), the lower right side and the upper left (unseen) side are the exterior surfaces of the wall, while in FIG. 6(*b*), the left side and the right (unseen) side are the exterior surfaces of the wall. Both depict staggered courses, as seen by the offset side-to-side of each of the three successive courses. Both also depict staggered wythe construction, with half blocks shown in darker shading on a course which has been offset by one wavelength with respect to the courses on which they rest and the courses resting upon them. The remainder of a wall is constructed in this fashion. Walls constructed as described provide excellent radiation shielding, with essentially no seams through which radiation is permitted to leak. Compared to a conventional construction with the same highly dense material but without the use of curved blocks of the invention, the wall of the invention provides the same radiation protection of a conventional wall of twice the thickness (i.e., twice the number of wythes).

The present invention is not to be limited in scope by the specific embodiments described above, which are intended as illustrations of aspects of the invention. Functionally equivalent methods and components are within the scope of the invention. Indeed, various modifications of the invention, in addition to those shown and described herein, will become apparent to those skilled in the art from the foregoing description. Such modifications are intended to fall within the scope of the appended claims. All cited references are hereby incorporated by reference.

What is claimed is:

1. A radiation shielding block system for constructing structural barriers, the radiation shielding block system comprising:

a plurality of radiation shielding blocks, each radiation shielding block comprising flat opposed front and rear surfaces defining a thickness of the block, continuously curved, sinusoidal opposed left and right surfaces, and continuously curved, sinusoidal opposed top and bottom surfaces;

the continuously curved, sinusoidal surfaces further comprising:

a regular repeating wavelength pattern having a wave direction that is perpendicular to the flat front and rear surfaces; and a length that is two complete wavelengths of a sinusoidal wave and that extends in the wave direction over the entire thickness of the block;

the plurality of the radiation shielding blocks are stacked in a staggered course construction having a plurality of courses and a plurality of wythes in which each successive course of blocks is offset laterally by one half the width of the blocks from the previous course and each successive course of blocks is set atop a previous course of blocks such that the continuously curved, sinusoidal surfaces of the successive course of blocks engage complementary continuously curved, sinusoidal surfaces of the previous course of blocks, and each successive course of blocks is offset by one wavelength from the previous course of blocks in a front-rear direction such that the bottom surface of each block in the successive course overlaps two blocks in the previous course.

2. The radiation shielding block system of claim 1, wherein the barriers are radiation-protective, and wherein each radiation shielding block has a density in the range between 150 pounds and 400 pounds per cubic foot.

3. The radiation shielding block system of claim 1, wherein each radiation shielding block has a density is in the range between 200 and 350 pounds per cubic foot.

4. The radiation shielding block system of claim 1, wherein each radiation shielding block has a density is in the range between 250 and 313 pounds per cubic foot.

5. The radiation shielding block system of claim 1, wherein an amplitude of the sine wave is between 0.2 and 0.7 wavelengths.

6. The radiation shielding block system of claim 1, wherein an amplitude of the sinusoidal wave is between 0.2 and 0.4 wavelengths.

7. The radiation shielding block system of claim 1, wherein each radiation shielding block is 10 inches in width, 5 inches in height, and 5 inches in depth.

8. The radiation shielding block system of claim 1, further comprising a plurality of half blocks positionable in the courses offset and recessed from an exterior surface of the barrier.

* * * * *